US007848873B2

(12) United States Patent
Fuwa et al.

(10) Patent No.: US 7,848,873 B2
(45) Date of Patent: Dec. 7, 2010

(54) CONTROL APPARATUS FOR INTERNAL COMBUSTION ENGINE

(75) Inventors: Naohide Fuwa, Toyota (JP); Yasuomi Takeuchi, Zaventem (BE); Takashi Kawasaki, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 431 days.

(21) Appl. No.: 11/815,769

(22) PCT Filed: Jan. 27, 2006

(86) PCT No.: PCT/JP2006/301811

§ 371 (c)(1),
(2), (4) Date: Feb. 20, 2008

(87) PCT Pub. No.: WO2006/085477

PCT Pub. Date: Aug. 17, 2006

(65) Prior Publication Data

US 2009/0132154 A1 May 21, 2009

(30) Foreign Application Priority Data

Feb. 8, 2005 (JP) ..... 2005-032029

(51) Int. Cl.
*F02D 45/00* (2006.01)

(52) U.S. Cl. ..... 701/112; 123/90.17; 123/347

(58) Field of Classification Search ... 123/90.15–90.18, 123/347, 399, 403, 491, 198 DB, 179.3, 179.4, 123/179.14, 179.16, 179.18; 701/101–103, 701/110, 112, 113

See application file for complete search history.

(56) References Cited

U.S. PATENT DOCUMENTS

| | | | | |
|---|---|---|---|---|
| 4,649,880 | A * | 3/1987 | Asano et al. | 123/399 |
| 5,984,429 | A * | 11/1999 | Nell et al. | 303/113.4 |
| 6,006,706 | A | 12/1999 | Kanzaki | |
| 6,276,317 | B1 | 8/2001 | Yoeda et al. | |
| 6,505,586 | B1 | 1/2003 | Sato et al. | |
| 6,626,144 | B1 * | 9/2003 | Kanamaru | 123/399 |
| 6,742,487 | B2 * | 6/2004 | Yamaguchi et al. | 123/179.3 |
| 6,807,934 | B2 * | 10/2004 | Kataoka et al. | 123/179.4 |
| 6,950,739 | B2 * | 9/2005 | Matsubara et al. | 701/103 |
| 7,079,939 | B2 * | 7/2006 | Kataoka et al. | 701/112 |
| 7,281,510 | B2 * | 10/2007 | Kondo | 123/179.5 |
| 2004/0159297 | A1 | 8/2004 | Kataoka et al. | |

FOREIGN PATENT DOCUMENTS

| | | |
|---|---|---|
| DE | 100 50 170 | 4/2002 |

(Continued)

*Primary Examiner*—Stephen K Cronin
*Assistant Examiner*—Johnny H Hoang
(74) *Attorney, Agent, or Firm*—Oblon, Spivak, McClelland, Maier & Neustadt, L.L.P.

(57) ABSTRACT

An electronic control unit 9 performs a delay control for extending the period from when an engine stop request is made to when the engine is actually stopped. During non-execution of the delay control, the electronic control unit 9 adjusts the opening degree of a throttle valve 38 according to an accelerator pedal depression degree. During the execution of the delay control, the electronic control unit 9 adjusts the opening degree of a throttle valve 38 such that the opening degree becomes less than the opening degree during the non-execution of the delay control.

20 Claims, 10 Drawing Sheets

FOREIGN PATENT DOCUMENTS

| | | |
|---|---|---|
| EP | 1 469 195 | 10/2004 |
| EP | 1 586 761 | 10/2005 |
| JP | 56-148630 | 11/1981 |
| JP | 60-1936 | 1/1985 |
| JP | 60-88832 | 5/1985 |
| JP | 61-218742 | 9/1986 |
| JP | 1-69149 | 5/1989 |
| JP | 6-336968 | 12/1994 |
| JP | 9-49446 | 2/1997 |
| JP | 11-173171 | 6/1999 |
| JP | 2000-282969 | 10/2000 |
| JP | 2000-328986 | 11/2000 |
| JP | 2001-41012 | 2/2001 |
| JP | 2001 263015 | 9/2001 |
| JP | 2002 161766 | 6/2002 |
| JP | 2002 357136 | 12/2002 |

* cited by examiner

CONTROL APPARATUS FOR INTERNAL COMBUSTION ENGINE

FIELD OF THE INVENTION

The present invention relates to a control apparatus for an internal combustion engine.

BACKGROUND OF THE INVENTION

Variable valve actuation mechanisms that change the valve actuation of engine valves such as intake valves and exhaust valves according to the engine operating state have been made commercially available.

Such variable valve actuation mechanisms include variable valve timing mechanisms. A variable valve timing mechanism uses hydraulic pressure generated by engine power or electricity as a drive source to change the rotational phase of a camshaft relative to the crankshaft, thereby changing the valve timing of the intake valves opened and closed by the camshaft to correspond to the operating state. Japanese Laid-Open Patent Publication No. 2001-263015 discloses a variable valve actuation mechanism that uses power source obtained from engine power to change the opening period and lift of engine valves to correspond to the engine operating state.

When a driver turns off the ignition switch, that is, when an engine stop request is made, fuel injection and fuel ignition are stopped so that the engine is stopped. Accordingly, a variable valve actuation mechanism is stopped while preserving the valve characteristics immediately before the engine stop. The valve characteristics after the engine is stopped are the same as the valve characteristics immediately before the engine is stopped, that is, the valve characteristics that have been set during the operation of the engine. These valve characteristics are not necessarily suitable for starting the engine. Thus, depending on conditions, startability of the engine could be degraded next time the engine is started.

Accordingly, Japanese Laid-Open Patent Publication No. 2002-161766 discloses an apparatus that performs a delay control for extending the period from when an engine stop request is made to when the engine is actually stopped. While the delay control is being performed, that is, while the power source from the engine power is available, a variable valve actuation mechanism is driven to change the valve characteristics to predetermined characteristics suitable for stating the engine.

SUMMARY OF THE INVENTION

When the delay control is performed, the engine continues operating for a while after an engine stop request is made by the driver. It is therefore important to increase the safety of the engine operation when performing the delay control. In this respect, the conventional apparatuses still have room for improvement.

Accordingly, it is an objective of the present invention to provide a control apparatus for an internal combustion engine that increases the safety of engine operation when performing a delay control.

Means for achieving the above objectives and advantages thereof will now be discussed.

A first aspect of the invention provides a control apparatus for an internal combustion engine, comprising: delay means that performs a delay control for extending the period from when an engine stop request is made to when the engine is actually stopped; changing means that actuates a variable valve actuation mechanism during the execution of the delay control, thereby changing the valve characteristics of an engine valve to valve characteristics for starting the engine; and setting means that sets an engine control amount that corresponds to engine manipulation performed by a driver. The control apparatus includes limiting means that causes the engine control amount set during the execution of the delay control to be less than the engine control amount during non-execution of the delay control.

According to this configuration, the engine control amount set according to engine manipulation performed by the driver is set less during the execution of the delay control compared to the period of non-execution of the delay control. In other words, the engine control amount is less during the execution of the delay control than during the normal engine operation. Therefore, during the execution of the delay control, the problem that the engine operating state is significantly changed by an accidental manipulation of the driver even if the driver has made an engine stop request is prevented. This increases the safety of the engine operation during the execution of the delay control.

It is preferable that the setting means set an opening degree of a throttle valve according to a depression degree of an accelerator pedal, and that the limiting means cause the throttle valve opening degree set during the execution of the delay control to be less than the throttle valve opening degree during non-execution of the delay control.

According to this configuration, during the execution of the delay control, the throttle valve opening degree set according to the accelerator pedal depression degree is less than that during the non-execution of the delay control, that is, that during the normal operating state. Therefore, during the execution of the delay control, accidental depression of the accelerator pedal by the driver increases the throttle valve opening degree by an amount less than that in the normal operating state. Thus, according to this configuration, during the execution of the delay control, if the engine power and the engine speed are not increased by accidental depression of the accelerator pedal by the driver. This increases the safety of the engine operation during the execution of the delay control.

It is preferable that the limiting means, during the execution of the delay control, inhibit setting of the throttle valve opening degree that corresponds to the accelerator pedal depression degree.

According to this configuration, the throttle valve opening degree is inhibited from being set according to the accelerator pedal depression degree during the execution of the delay control. Therefore, during the execution of the delay control, accidental depression of the accelerator pedal by the driver does not change the throttle valve opening degree. Thus, according to this configuration, during the execution of the delay control, if the engine power and the engine speed are not increased by accidental depression of the accelerator pedal by the driver. This increases the safety of the engine operation during the execution of the delay control.

A second aspect of the invention provides a control apparatus for an internal combustion engine, comprising: delay means that performs a delay control for extending the period from when an engine stop request is made to when the engine is actually stopped; and changing means that actuates a variable valve actuation mechanism during the execution of the delay control, thereby changing the valve characteristics of an engine valve to valve characteristics for starting the engine. The control apparatus further includes: determination means that determines whether the engine stop request is an urgent stop request: and inhibiting means, wherein, when the determination means determines that the stop request is an urgent stop request, the inhibiting means inhibits the execution of the delay control.

According to this configuration, whether an engine stop request made by the driver is an urgent stop request for promptly stopping the engine is determined by the determination means. If the request is determined to be an urgent stop request, the inhibiting means inhibits the execution of delay control. Therefore, when the driver has made an urgent stop request, the engine operation is promptly stopped without executing the delay control, so that the safety of the engine operation during the execution of the delay control is increased.

It is preferable that, when the engine stop request is made during cranking of the engine, the determination means determine that the engine stop request is the urgent stop request.

Cranking of the engine 1 is performed when the driver makes an engine start request. Therefore, if the driver makes an engine stop request during cranking, the engine stop request is determined to be an urgent stop request. Thus, when an engine stop request is made during cranking of the engine, the above configuration that determines whether the engine stop request is an urgent stop request reliably determines whether the engine stop request made by the driver is the urgent stop request.

When an engine stop request is made during cranking, the engine is stopped promptly. Therefore, the vehicle mounting the engine that executes the delay control is prevented from starting moving due to the execution of the delay control during cranking.

It is preferable that, when the engine stop request is made with the hood of the vehicle mounting the engine opened, the determination means determine that the engine stop request is the urgent stop request.

When the hood of the vehicle is open, a foreign object could become entangled with moving components in the engine compartment. Therefore, when an engine stop request is made with the vehicle hood opened, the driver has could have made the request because a foreign object is entangled with moving components, and the request could be an urgent engine stop request. Accordingly, in the above configuration, if an engine stop request is made with the hood opened, whether the request is an urgent stop request is determined. Therefore, according this configuration, whether the engine stop request made by the driver is an urgent stop request is reliably determined.

When an engine stop request is made with the hood opened, the engine is stopped promptly. Therefore, with the hood opened, when the driver discovers foreign entangled in the engine compartment, the engine 1 is promptly stopped based on an engine stop request made by the driver.

The determination means preferably determines whether the engine stop request is the urgent stop request based on an engine speed at the time when the engine stop request is made.

During the normal engine operation, it is unlikely that the driver requests an engine stop request when the engine speed is relatively high. Therefore, in such a condition, an engine stop request can be determined to be an urgent stop request. In the above configuration, whether an engine stop request is an urgent stop request is determined based on the engine speed at the time when the engine stop request is made. According to this configuration, whether the engine stop request made by the driver is an urgent stop request is reliably determined. It is preferable in this configuration that an engine stop request be determined to be an urgent stop request when the engine speed at the time when the engine stop request is made is higher than the engine speed at the time when an engine stop request is made during the normal operation of the engine.

Whether an engine stop request is an urgent stop request is determined based on the engine speed at the time when the engine stop request is made. If the engine stop request is determined to an urgent stop request, the execution of the delay control is inhibited. Therefore, if the driver makes an engine stop request when the engine speed is excessively high, the engine is promptly stopped.

A third aspect of the invention provides a control apparatus for an internal combustion engine, comprising: delay means that performs a delay control for extending the period from when an engine stop request is made to when the engine is actually stopped; and changing means that actuates a variable valve actuation mechanism during the execution of the delay control, thereby changing the valve characteristics of an engine valve to valve characteristics for starting the engine. During the execution of the delay control, a stop mechanism that stops wheels of a vehicle mounting the engine is actuated.

If the delay control is executed when the engine power could rotate vehicle wheels, for example, when the driver is applying the brakes, when the clutch of the transmission is engaged, or when the shift lever is not in the neutral position, the vehicle could start moving despite the fact that the engine stop request has been made by the driver. In this configuration, the wheels are stopped by the stop mechanism during the execution of the delay control. Thus, the problem that the execution of the delay control causes the vehicle to start moving is prevented. This increases the safety of the engine operation during the execution of the delay control.

Also, according to this configuration, since the wheels are stopped by the stop mechanism during the execution of the delay control, a contingency that the vehicle starts moving even if an engine stop request has been made is prevented without the above described determination means and inhibiting means process.

The stop mechanism may be comprise brakes actuated by an actuator. The vehicle wheels are therefore reliably stopped without relying on manipulation by the driver.

A fourth aspect of the invention provides a control apparatus for an internal combustion engine, comprising: delay means that performs a delay control for extending the period from when an engine stop request is made to when the engine is stopped; and changing means that actuates a variable valve actuation mechanism during the execution of the delay control, thereby changing the valve characteristics of an engine valve to valve characteristics for starting the engine. The control apparatus further includes a fuel pump is stopped at the time when the engine stop request is made.

According to this configuration, the supply of fuel to a fuel injection valve is promptly stopped when an engine stop request is made. Therefore, even if the continuation of the engine operation according to the delay control is ended, that is, even if there is an abnormality in the delay control, the engine operation is reliably stopped. This increases the safety of the engine operation.

A fifth aspect of the invention provides a control apparatus for an internal combustion engine, comprising: delay means that performs a delay control for extending the period from when an engine stop request is made to when the engine is stopped; and changing means that actuates a variable valve actuation mechanism during the execution of the delay control, thereby changing the valve characteristics of an engine valve to valve characteristics for starting the engine. During the execution of the delay control, a fuel pump is stopped when a predetermined period has elapsed since the engine stop request is made.

According to this configuration, the supply of fuel to a fuel injection valve is stopped even during the execution of the delay control when the predetermined period has elapsed since an engine stop request is made. Therefore, in this configuration, if the continuation of the engine operation according to the delay control is ended, that is, if there is an abnormality in the delay control, the engine operation is reliably stopped. This increases the safety of the engine operation. The predetermined period is preferably set to the period required for changing the valve characteristics of the engine valve to the valve characteristics for starting the engine during the execution of the delay control.

A sixth aspect of the invention provides a control apparatus for an internal combustion engine, comprising: a main relay formed in a circuit independent from an engine stopping switch, the main relay performing and shutting off the supply of electricity used for controlling the engine; a separate relay formed in a circuit independent from the engine stopping switch, the separate relay performing and shutting off the supply of electricity to at least one of a fuel injection valve and an ignition plug; delay means that performs a delay control for extending the period from when an engine stop request is made by a driver to when the separate relay shuts off the supply of electricity; and changing means that actuates a variable valve actuation mechanism during the execution of the delay control, thereby changing the valve characteristics of an engine valve to valve characteristics for starting the engine. The main relay performs and shuts off the supply of electricity to the separate relay.

To perform the delay control, electricity needs to be supplied to the fuel injection valve injector and the ignition plug through a circuit that is independent from the engine stopping switch. The main relay of this configuration, which performs and shuts off the supply of electricity used in the engine control, performs and shuts off the supply of electricity to the separate relay that performs and shuts off the supply of electricity to at least one of the fuel injection valve and the ignition plug. Therefore, when the main relay is off, the supply of electricity to the separate relay is reliably stopped so that the supply of electricity to the fuel injection valve and the ignition plug is reliably stopped. That is, the supply of electricity to the separate relay is not erroneously performed when the main relay is off. Thus, in the case where the electricity is supplied to the injection valve and the ignition plug through a circuit independent from the engine stopping switch, the supply of electricity to the injection valve and the ignition plug is reliably stopped. This increases the safety of the engine operation during the execution of the delay control.

If a coil of the separate relay is connected to a downstream side of a contact of the main relay, the main relay is permitted to perform and shuts off the supply of electricity to the separate relay.

DETAILED DESCRIPTION OF THE PREFERRED EMBODIMENTS

First Embodiment

A controlling apparatus for an internal injection engine 1 according to a first embodiment of the present invention will now be described with reference to FIGS. 1 to 7.

Figure 1:
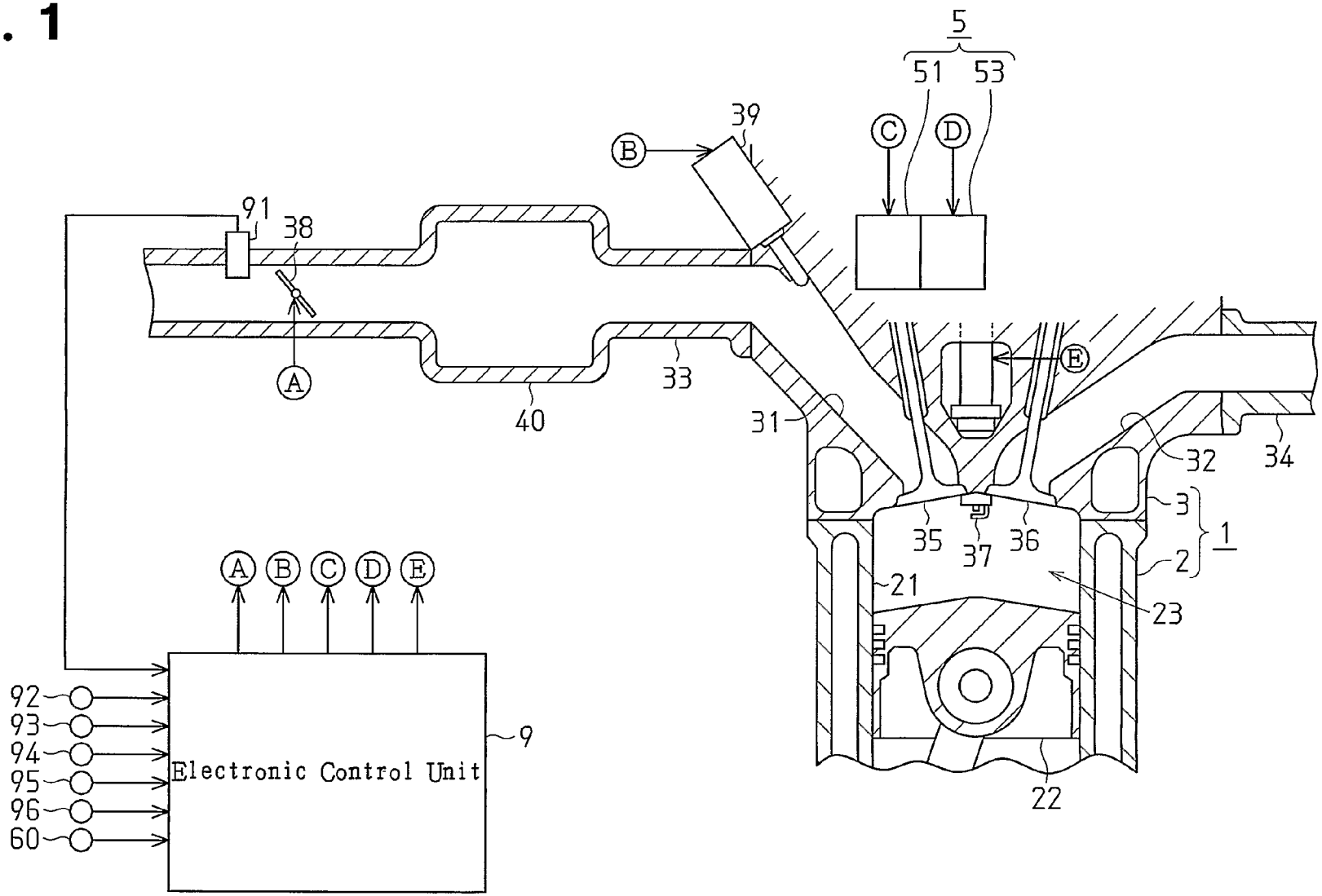
FIG. 1 is a diagram illustrating an internal combustion engine to which a control apparatus according to a first embodiment of the present invention is applied.

FIG. 1 illustrates the configuration of the engine 1 according to this embodiment.

As shown in FIG. 1, the engine 1 has a cylinder block 2 and a cylinder head 3. The cylinder block 2 has cylinders 21. The engine 1 also combustion chambers 23, injectors 39, ignition plugs 37, intake ports 31, exhaust ports 32, intake valves 35, exhaust valves 36, and pistons 22 each corresponding to one of the combustion chambers 23. In the following, only one set of a cylinder 21, a combustion chamber 23, an injector 39, an ignition plug 37, an intake port 31, an exhaust port 32, an intake valve 35, an exhaust valve 36, and a piston 22 will mainly be discussed as representing all the cylinders 21, combustion chambers 23, injectors 39, ignition plugs 37, intake ports 31, exhaust ports 32, intake valves 35, exhaust valves 36, and pistons 22. The piston 22 is housed in the cylinder 21 to reciprocate inside the cylinder 21. The combustion chamber 23 is defined in the cylinder 21 by the inner circumferential surface of the cylinder 21, the top of the piston 22, and the cylinder head 3.

The intake port 31 and the exhaust port 32 are provided for the cylinder head 3. An intake pipe 33 is connected to the intake port 31, and an exhaust pipe 34 is connected to the exhaust port 32. The intake port 31 and the combustion chamber 23 are connected to and disconnected from each other by opening and closing the intake valve 35, while the exhaust port 32 and the combustion chamber 23 are connected to and disconnected from each other by opening and closing the exhaust valve 36. The injector 39 is provided in the intake port 31 to inject fuel into the intake port 31.

The ignition plug 37 is provided in a section of the cylinder head 3 that forms the top of the combustion chamber 23. The ignition plug 37 sparks to ignite air-fuel mixture.

A surge tank 40 is provided in the intake pipe 33. A throttle valve 38 is located in a section upstream of the surge tank 40 to adjust the flow rate of air drawn into the combustion chamber 23. The throttle valve 38 is an electric throttle valve that is opened and closed by an electric motor. The opening degree of the throttle valve 38 is adjusted according to the degree of depression of an accelerator pedal.

A variable valve actuation mechanism 5 is provided in the cylinder head 3 to change the valve characteristics of the intake valve 35. The variable valve actuation mechanism 5 includes a variable valve-timing mechanism 51 that changes the valve timing of the intake valve 35, and a variable valve lift mechanism 53 that changes the maximum valve lift VL and the valve duration INCAM of the intake valve 35. The valve duration INCAM of the intake valve 35 corresponds to a period during which the intake valve 35 is open.

Figure 2:
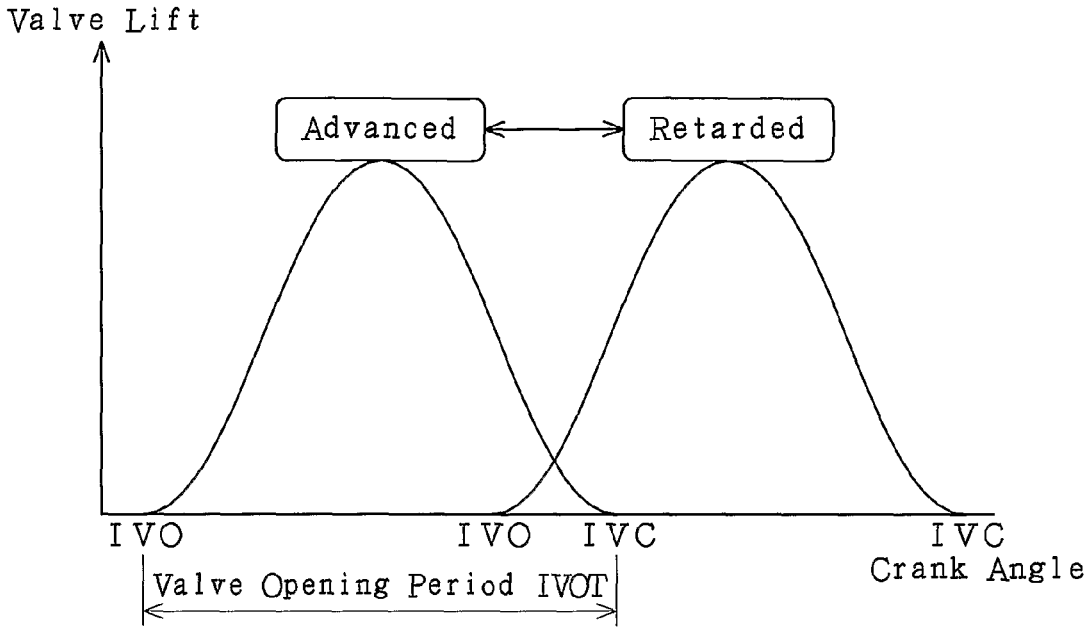
FIG. 2 is a schematic diagram showing the valve timing of an intake valve changed by a variable valve timing mechanism according to the first embodiment.
Figure 3:
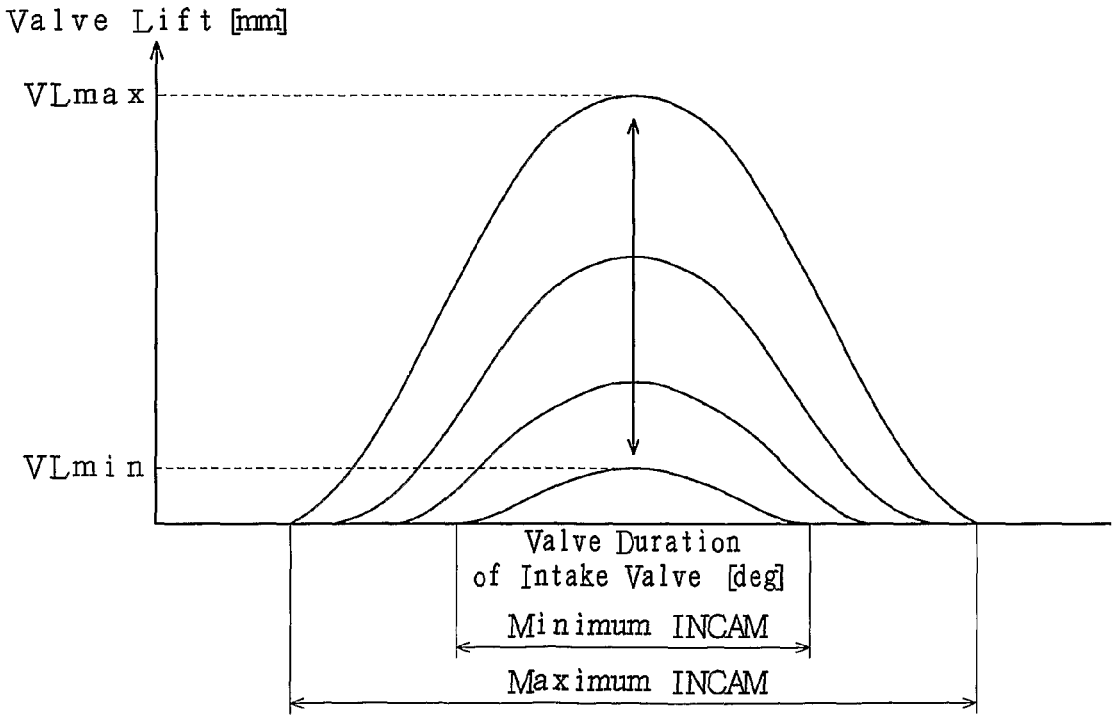
FIG. 3 schematic diagram showing the maximum valve lift and the valve duration of the intake valve changed by a variable valve lift mechanism according to the first embodiment.

The variable valve timing mechanism 51 is actuated by hydraulic pressure generated by a hydraulic pump driven by the engine power. The variable valve timing mechanism 51 changes the relative rotational phase between a camshaft actuating the intake valve 35 and the crankshaft of the engine 1, there varying the valve timing INVT of the intake valve 35. As the valve timing INVT is changed, the point at which the intake valve 35 opens and the point at which the intake valve 35 closes (IVC) are both advanced or retarded by the same degrees of the crank angle. That is, in the state where the period during which the intake valve 35 is open (IVOT) is constant as shown in FIG. 2, IVO and IVC are advanced or retarded.

The variable valve lift mechanism 53 is a mechanism that is driven by electricity of an alternator driven by the engine power. The variable valve lift mechanism 53 changes the maximum valve lift VL of the intake valve 35 and the valve duration INCAM, that is, the valve opening period IVOT. The variable valve lift mechanism 53 continuously changes the maximum valve lift VL of the intake valve 35 between an upper limit valve lift VLmax and a lower limit valve lift VLmin. In synchronization with the continuous change in the maximum valve lift VL, the valve duration INCAM of the intake valve 35 is continuously changed. That is, the valve duration INCAM is maximum at the upper limit lift VLmax. As the maximum valve lift VL is reduced, the valve duration INCAM is reduced accordingly. The valve duration INCAM is minimum at the lower limit lift VLmin.

The variable valve lift mechanism 53 receives reaction force from the camshaft and the intake valve 35. The reaction force acts to increase the maximum valve lift VL. Therefore, when increasing the maximum valve lift VL, the electricity consumption of the actuator driving the variable valve lift mechanism 53 increases. Accordingly, the load on the battery will be considerable. In this embodiment, the variable valve lift mechanism 53 is actuated only when the alternator is generating electricity, in other words, when the engine 1 is operating.

Various types of controls such as a fuel injection control, an ignition timing control, an intake air amount control, and a variable valve actuation control of the intake valve 35 are executed by an electronic control unit 9.

The electronic control unit 9 includes a central processing unit (CPU) that performs computation processes related to the engine control, memory for storing various types of programs and information required for the engine control, and input and output ports for inputting and outputting signals from and to the outside. The input port is connected to various types of sensors that detect the engine operating state.

An intake air amount sensor 91 detects the flow rate of air passing through the intake pipe 33 (intake air amount GA). A crank angle sensor 92 detects the rotation angle of the crankshaft, that is, the crank angle. Based on the detection signal of the crank angle, the engine speed NE is computed. A throttle opening degree sensor 93 detects the opening degree (throttle opening degree TA) of the throttle valve 38. A valve timing sensor 94 detects the valve timing INVT of the intake valve 35. A lift sensor 95 detects the operating state of the variable valve lift mechanism 53, that is, the current value of the maximum valve lift VL of the intake valve 35. An accelerator pedal sensor 96 detects the depression degree of the accelerator pedal (ACCP). Also, the state of an ignition switch (hereafter, referred to as IG switch) 60 manipulated by a driver, that is, a signal indicating whether the IG switch 60 is in the on state or the off state is sent to the input port of the electronic control unit 9.

The output port of the electronic control unit 9 is connected to drive circuits of the ignition plug 37, the throttle valve 38, the injector 39, the variable valve timing mechanism 51, and the variable valve lift mechanism 53. The electronic control unit 9 controls the operation of the ignition plug 37 and the injector 39 based on the engine operating state detected by the above listed sensors. Based on the accelerator pedal depression degree ACCP, the electronic control unit 9 sets a target value of the opening degree of the throttle valve 38, and controls the throttle valve 38 to seek the target opening degree. Then, the electronic control unit 9 controls the variable valve timing mechanism 51 and the variable, valve lift mechanism 53 to realize a valve actuation suitable for the engine operating state.

When the driver turns off the IG switch, that is, when an engine stop request is made by the driver, fuel injection and fuel ignition are stopped, so that the engine 1 is stopped. Accordingly, the generation of hydraulic pressure acting as the drive source of the variable valve timing mechanism 51 and the generation of electricity acting as the drive source of the variable valve lift mechanism 53 are stopped. Therefore, the variable valve actuation mechanism 5 is stopped with the valve characteristics immediately before the engine stop. The valve characteristics after the engine is stopped are the valve characteristics immediately before the engine 1 is stopped, that is, a valve characteristics that have been set during the operation of the engine 1. These valve characteristics are not necessarily suitable for starting the engine 1. Thus, depending on conditions, startability of the engine could be degraded next time the engine is started.

Accordingly, in this embodiment, a delay control is performed for extending the period from when an engine stop request is made to when the engine 1 is actually stopped. While the delay control is being performed, that is, while the hydraulic pressure and electricity are being generated, the variable valve timing mechanism 51 and the variable valve lift mechanism 53 are driven to change the valve characteristics to predetermined characteristics suitable for stating the engine. For example, during the execution of the delay control, the valve timing INVT is shifted to a valve timing near the most delayed valve timing, and the maximum valve lift VL is shifted to a valve lift near the upper limit lift VLmax, so that the valve characteristics are ready for the next starting of the engine 1.

To perform the delay control, electricity needs to be supplied to the injector 39 and the ignition plug 37 through a circuit that is independent from the IG switch 60, which is an engine stopping switch. Accordingly, electricity is supplied to the injector 39 and the ignition plug 37 through the circuit described below.

Figure 4:
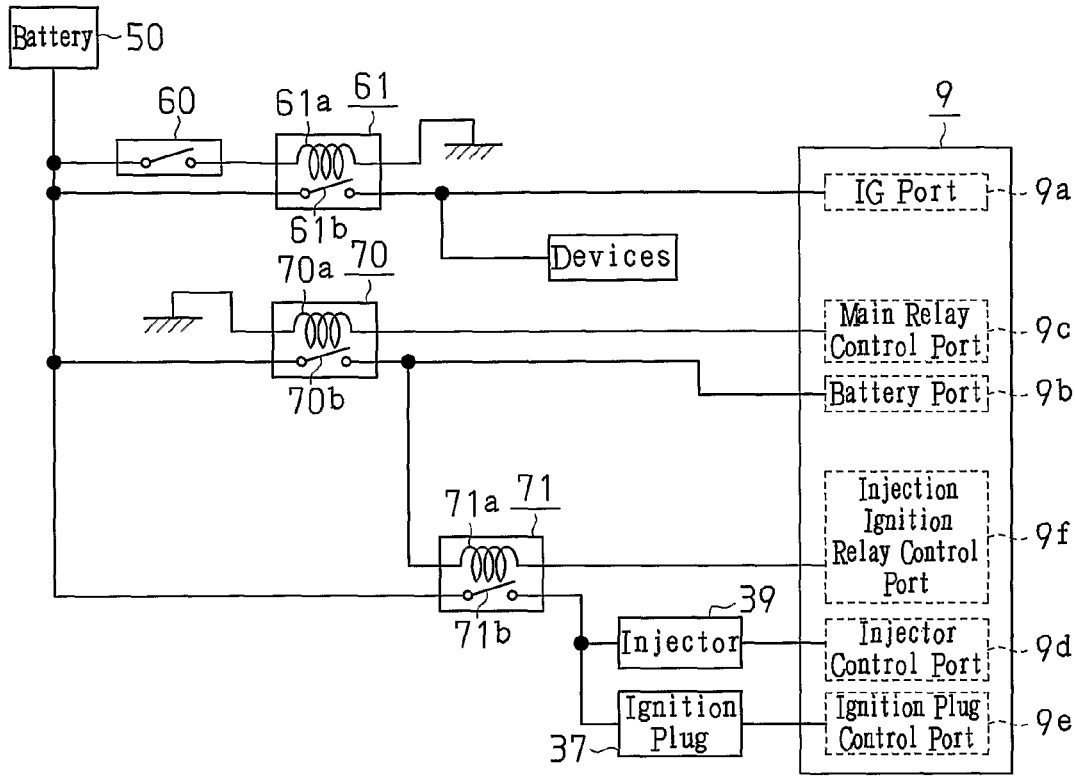
FIG. 4 is a schematic diagram showing circuitry for supplying electricity to injectors and ignition plugs in the first embodiment.

FIG. 4 illustrates the basic structure of a circuit for supplying electricity to the injector 39 and the ignition plug 37. As shown in FIG. 4, the positive terminal of a battery 50 is connected to a first end of the IG switch 60, the other end of the IG switch 60 is connected to a first end of a coil 61*a* of an IG relay 61. A second end of the coil 61*a* is grounded. A first end of a contact 61*b* of the IG relay 61 is connected to the positive terminal of the battery 50, and a second end of the contact 61*b* is connected to an IG port 9*a* of the electronic control unit 9 and various types of electric devices (an airbag initiator and a meter panel).

In the circuit having the IG switch 60 as a main component, when the driver turns the IG switch 60 on or off, the coil 61*a* is excited or de-excited, thereby opening or closing the contact 61*b*. By closing and opening the contact 61*b*, supply of electricity to the various types of electric devices is performed and shut off, and an engine start request and engine stopping request by the driver are recognized.

The positive terminal of the battery 50 is connected to a first end of a contact 70*b* of a main relay 70 that performs and shuts off the supply of electricity for controlling the engine 1. A second end of the contact 70*b* is connected to a battery port 9*b* of the electronic control unit 9. A first end of a coil 70*a* of the main relay 70 is connected to a main relay control port 9*c* of the electronic control unit 9, and a second end of the coil 70*a* is grounded.

In this circuit, which has the main relay 70 as a main component, when the electronic control unit 9 recognizes an engine start request, a high level signal is outputted from the main relay control port 9*c*. Accordingly, the coil 70*a* is excited and the contact 70*b* is closed. When the contact 70*b* is closed, electricity is supplied to the battery port 9*b*. Accordingly, main electricity, or electricity for controlling the engine 1, is supplied to the electronic control unit 9. On the other hand, when an engine stop request is recognized, a low level signal is outputted from the main relay control port 9*c*. Accordingly, the coil 70*a* is de-excited and the contact 70*b* is opened. When the contact 70*b* is opened, electricity is not supplied to the battery port 9*b*. Accordingly, main electricity, or electricity for controlling the engine 1, stops being supplied to the electronic control unit 9. In this manner, the main relay 70 is formed in a circuit independent from the IG switch 60, and performs and shuts off the supply of electricity for controlling the engine 1.

The positive terminal of the battery 50 is connected to a first end of a contact 71*b* of an injection ignition relay 71 that performs and shuts off the supply of electricity to the injector 39 and the ignition plug 37. A second end of the contact 71*b* is connected to the injector 39 and to the ignition plug 37 via an igniter. The injector 39 is connected to a control port 9*d* of an injector control port 9*d* of the electronic control unit 9. The ignition plug 37 is connected via the igniter to an ignition plug control port 9*e* of the electronic control unit 9. A first end of a coil 71*a* of the injection ignition relay 71 is connected to the second end of the contact 70*b* of the main relay 70, that is, to the downstream side of the contact 71*b*. A second end of the coil 71*a* is connected to an injection ignition relay control port 9*f* of the electronic control unit 9.

Since the contact 70*b* of the main relay 70 is closed when the electronic control unit 9 recognizes an engine start request, voltage is applied to the coil 71*a* via the contact 70*b* in the circuit having the injection ignition relay 71 as a main component when an engine start request is recognized. When a low level signal is outputted from the injection ignition relay control port 9*f*, the coil 71*a* is excited and the contact 71*b* is closed. When the contact 71*b* is closed, electricity is supplied to the injector 39 and the ignition plug 37 via the contact 71*b*. Accordingly, fuel injection and fuel ignition are controlled according to signals from the injector control port 9*d* and the ignition plug control port 9*e*. On the other hand, when the electronic control unit 9 recognizes an engine stop request, the contact 70*b* of the main relay 70 is opened, and the application of voltage to the coil 71*a* via the contact 70*b* is stopped. Thus, the coil 71*a* is de-excited and the contact 71*b* is opened. Accordingly, the supply of electricity to the injector 39 and the ignition plug 37 is stopped. That is, fuel injection and fuel ignition are stopped, which stops the engine 1.

In this embodiment, the injection ignition relay 71 formed in a circuit independent from the IG switch 60 is used for starting and stopping the supply of electricity to the injector 39 and the ignition plug 37. On the other hand, the supply of electricity to the injection and ignition relay 71 is performed and shut off by the main relay 70. Therefore, when the main relay 70 is off, the supply of electricity to the injection ignition relay 71 is reliably stopped so that the supply of electricity to the injector 39 and the ignition plug 37 is reliably stopped. That is, the supply of electricity to the injection ignition relay 71 is not erroneously performed when the main relay 70 is off. Thus, in the case where the electricity is supplied to the injector 39 and the ignition plug 37 through a circuit independent from the IG switch 60, the supply of electricity to the injector 39 and the ignition plug 37 is reliably stopped. This increases the safety of the engine operation during the execution of the delay control.

Figure 5:
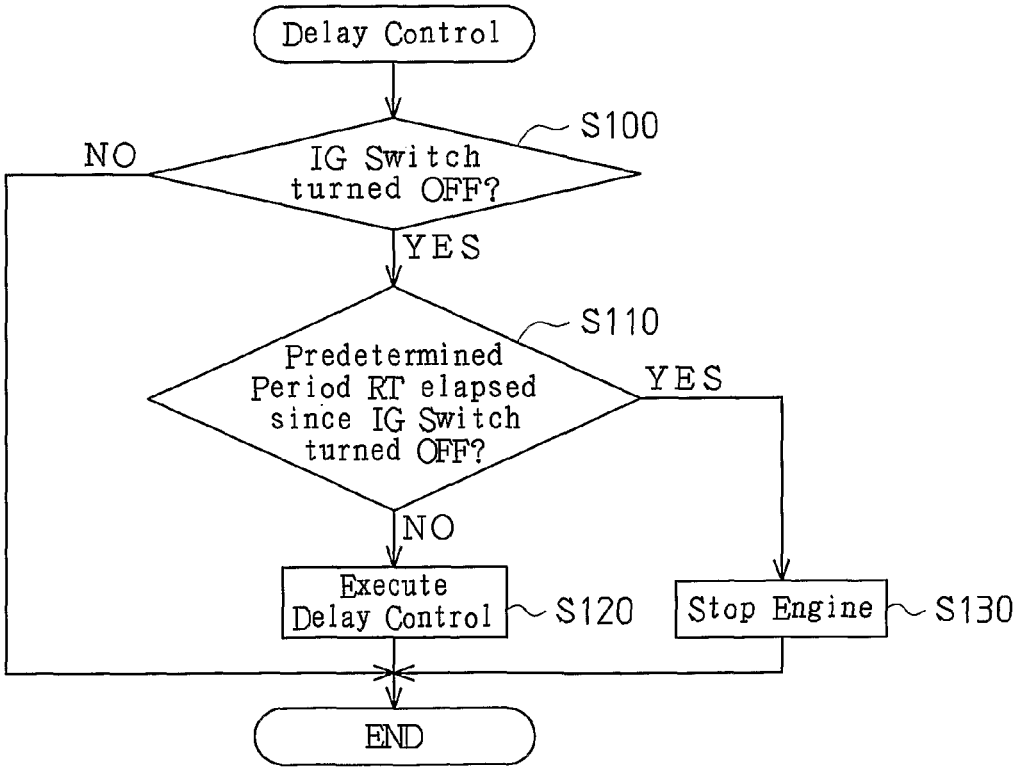
FIG. 5 is a flowchart showing a procedure of a delay control according to the first embodiment.

FIG. 5 shows the procedure of the delay control. The delay control is repeated at predetermined time intervals by the electronic control unit 9. The delay control corresponds to delay means.

When the process is started, whether the IG switch is turned off is determined (S100). If it is determined that the IG switch 60 is on (NO at S100), this process is temporarily suspended.

on the other hand, when the IG switch 60 is off (YES at S100), whether a predetermined period RT has elapsed since the IG switch 60 was turned off is determined (S110). The predetermined period RT is determined in advance as a period required for changing the valve characteristics at the time of turning the IG switch 60 off to valve characteristics for starting the engine 1.

If it is determined that the predetermined period RT has not elapsed (NO at S110), the delay control is executed. That is, even if the IG switch 60 is off, fuel injection and fuel ignition are continued. During the execution of the delay control, the variable valve timing mechanism 51 and the variable valve lift mechanism 53 are driven to change the valve characteristics of the intake valve 35 to the predetermined state suitable for stating the engine 1.

on the other hand, when it is not determined that the predetermined period RT has not elapsed (YES at S110), it is determined that the process for changing the valve characteristics of the intake valve 35 to the predetermined state suitable for starting the engine 1 has been completed. In this case, fuel injection and fuel ignition are stopped for stopping the delay control. That is, the engine 1 is stopped (S130), and the process is temporarily suspended.

In this embodiment, the delay control as described above is executed in the engine 1. When the delay control is performed, the engine continues operating for a while after an engine stop request is made by the driver. Therefore, it is important to increase the safety of the engine operation during the execution of the delay control.

For example, the throttle opening degree is adjusted in accordance with the accelerator pedal depression degree in this embodiment. That is, an engine control amount is set according to engine manipulation by the driver (depression of the accelerator pedal). During the execution of the delay control, accidental manipulation of the engine by the driver could significantly change the engine operating state even if the same driver has made an engine stop request. Specifically, if the driver accidentally depresses the accelerator pedal during the execution of the delay control, the engine power and the engine speed could be increased even if the driver has made an engine stop request.

In this embodiment, limiting means is provided that causes the engine control amount set during the execution of the delay control to be less than that when the delay control is not being executed (i.e. during non-execution of the delay control).

Hereinafter, a control for limiting the engine control amount according to the present embodiment will be described with reference to FIG. 6.

Figure 6:
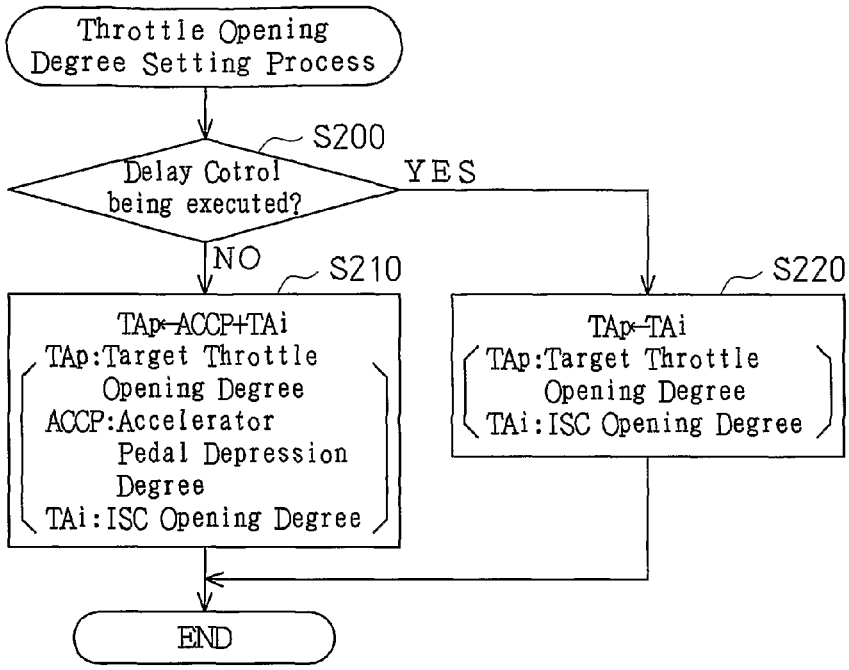
FIG. 6 is a flowchart showing a process for setting a throttle opening degree according to the first embodiment.

FIG. 6 shows a process corresponding to the engine control amount limiting means. Specifically, FIG. 6 shows a procedure for setting the throttle opening degree during the execution of the delay control. The throttle opening degree setting process is repeated at predetermined time intervals by the electronic control unit 9.

When the procedure is started, whether the delay control is being executed is determined (S200). When the delay control is not being executed (NO at S200), a target throttle opening degree TAp based on the following expression (1) for adjusting the throttle opening degree TA according to the accelerator pedal depression degree ACCP. Then the process is temporarily suspended. Step S210 corresponds to the setting means.

Target throttle opening degree *TAp*←Accelerator pedal depression degree *ACCP+ISC* opening degree *TAi* (1)

The ISC opening degree TAi refers to a throttle opening degree computed in an idle speed control, that is, a throttle opening degree required for maintaining an idle state of the engine. The ISC opening degree TAi is set according to the deviation between a predetermined idling speed and the engine speed NE. The ISC opening degree TAi is added to the throttle opening degree corresponding to the accelerator pedal depression degree ACCP to set the target throttle opening degree TAp. During the normal operation, or during the non-execution of the delay control, the accelerator pedal depression degree and the ISC opening degree are reflected on the target throttle opening degree TAp.

When the target throttle opening degree TAp is set, throttle valve 38 is controlled such that the throttle opening degree TA seeks the target throttle opening degree TAp.

on the other hand, if it is determined that the delay control is being executed at S200 (YES at S200), the target throttle opening degree TAp is set according to the following expression (2) at S220. The process is then temporarily suspended.

Target throttle opening degree TAp←ISC opening degree TAi (2)

As shown in expression (2), during the execution of the delay control, only the ISC opening degree is reflected on the target throttle opening degree TAp. Practically, setting of the opening degree of the throttle valve 38 according to the accelerator pedal depression degree ACCP is inhibited. In other words, the throttle opening degree set during the execution of the delay control is less than the throttle opening degree set during the non-execution of the delay control.

When the target throttle opening degree TAp is set, throttle valve 38 is controlled such that the throttle opening degree TA seeks the ISC opening degree TAi.

Figure 7:
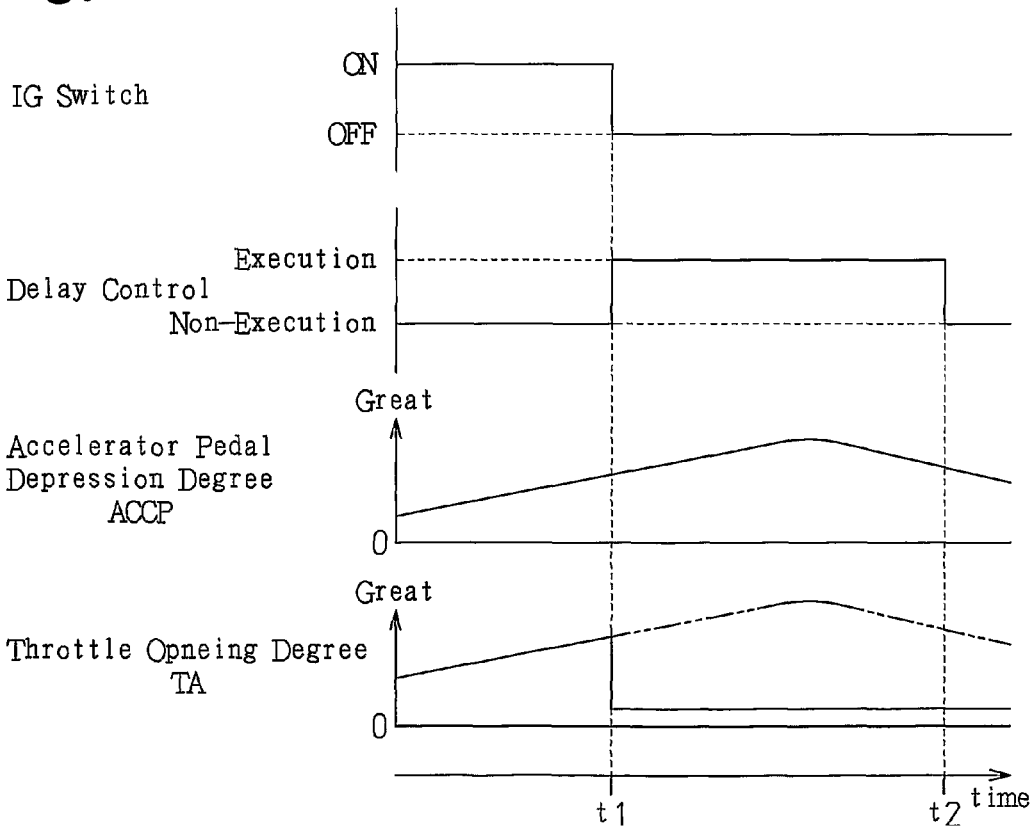
FIG. 7 is a time chart showing an example of changes in the throttle opening degree when the throttle opening degree setting process of FIG. 6 is executed.

FIG. 7 is a time chart showing an example of changes in the throttle opening degree TA when the throttle opening degree setting process is executed.

As shown in FIG. 7, when the IG switch is turned off at time t1, the delay control is started. When the predetermined period RT has elapsed since the delay control is started, the delay control is ended (time t2). During the execution of the delay control (in a period from time t1 to time t2), if the opening degree control of the throttle valve 38 according to the accelerator pedal depression degree ACCP is permitted, an accidental depression of the accelerator pedal by the driver increases the throttle opening degree TA (shown by alternate long and two short dashes line). This could increase the engine power and the engine speed. That is, even if the IG switch 60 is off and the driver has made an engine stop request, the accidental depression of the accelerator pedal could increase the engine power and the engine speed. In this respect, setting of the opening degree of the throttle valve 38 according to the accelerator pedal depression degree ACCP is inhibited during the execution of the delay control in this embodiment, so that only the ISC opening degree TAi is reflected on the target throttle opening degree TAp that is set during the execution of the delay control. Therefore, at the time when the delay control is started (time t1), the throttle opening degree TA is adjusted to the ISC opening degree TAi without referring to the accelerator pedal depression degree ACCP. During the execution of the delay control, accidental depression of the accelerator pedal by the driver does not cause the opening degree of the throttle valve 38 to be changed in accordance with the accelerator pedal depression degree. Thus, during the execution of the delay control, if the engine power and the engine speed are not increased by accidental depression of the accelerator pedal. This increases the safety of the engine operation during the execution of the delay control.

The embodiment described above provides the following advantages.

(1) During the execution of the delay control, the opening degree of the throttle valve 38 is prevented from being set according to the accelerator pedal depression degree ACCP. Thus, during the execution of the delay control, if the engine power and the engine speed are not increased by accidental depression of the accelerator pedal. This increases the safety of the engine operation during the execution of the delay control.

(2) In the main relay 70, which performs and shuts off the supply of electricity used in the engine control, the supply of electricity to the injection ignition relay 71, which performs and shuts off the supply of electricity to the injector 39 and the ignition plug 37, is performed and shut off. Therefore, the supply of electricity to the injection ignition relay 71 is not erroneously performed when the main relay 70 is off. Thus, in the case where the electricity is supplied to the injector 39 and the ignition plug 37 through a circuit independent from the IG switch 60, the supply of electricity to the injector 39 and the ignition plug 37 is reliably stopped. This increases the safety of the engine operation during the execution of the delay control.

(3) Since the coil 71*a* of the injection ignition relay 71 is connected to the downstream side of the contact 71*b* of the main relay 70, the supply of electricity to the injection ignition relay 71 from the main relay 70 is reliably performed and shut off.

Second Embodiment

A control apparatus for an internal injection engine according to a second embodiment of the present invention will now be described with reference to FIG. 8.

In the first embodiment, the process for setting the throttle opening degree described above is executed to increase the safety of the engine operation during the execution of the delay control. In the second embodiment, the safety of the engine operation is increased in a different manner. That is, in this embodiment, it is determined whether an engine stop request made by the driver is an urgent stop request for promptly stopping the engine operation. When an engine stop request is determined to be an urgent stop request, a process for determining whether the delay control should be is executed, or an execution determination process, is executed. Other than this process, the second embodiment is the same as the first embodiment. Therefore, hereinafter, the control apparatus for an internal combustion engine according to this embodiment will be described while mainly discussing the execution determination process.

Figure 8:
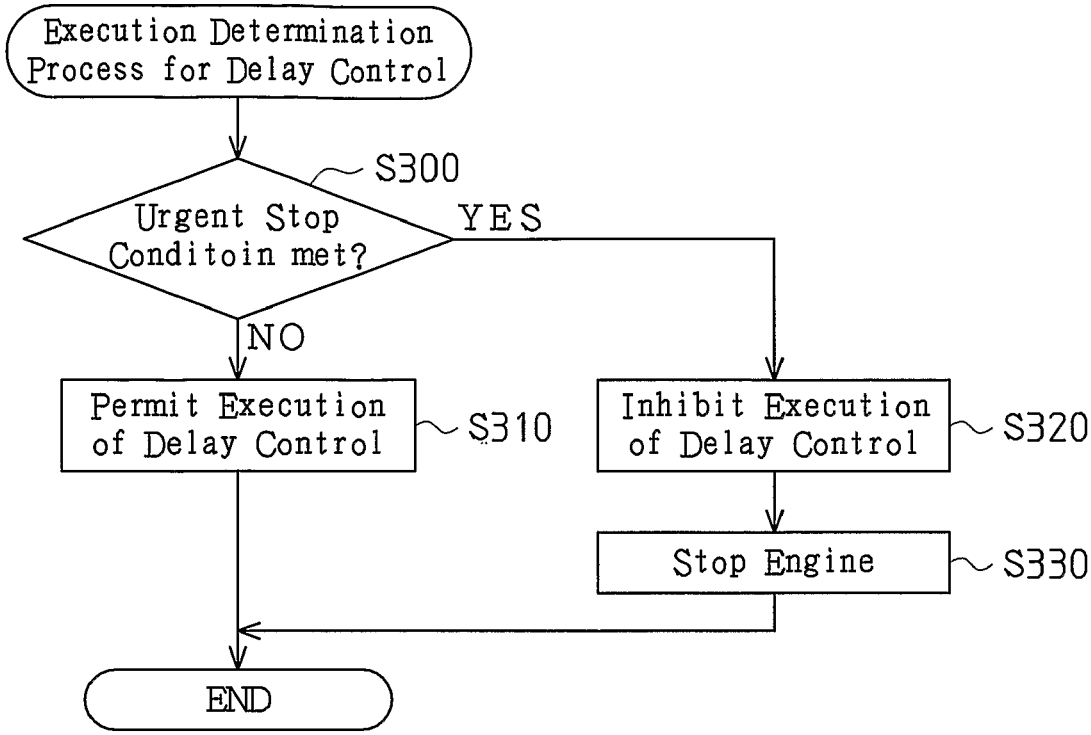
FIG. 8 is a flowchart showing a procedure for determining whether to execute a delay control according to a second embodiment.

FIG. 8 shows a procedure for the execution determination process for the delay control. The execution determination process is executed by the electronic control unit 9 when the IG switch 60 is turned off, that is, when the driver makes an engine stop request.

When the process is started, whether an urgent stop condition is met is determined (S300). The urgent stop condition is determined to be met when any of the following conditions (a) to (c) is met. Step S300 corresponds to the determination means.

(a) When the driver makes an engine stop request during cranking of the engine 1.

The condition (a) is set for the following reasons. That is, cranking of the engine 1 is performed when the driver makes an engine start request. Therefore, if the driver makes an engine stop request during cranking, the engine stop request can be determined to be an urgent stop request. Whether the engine 1 is being cranked is determined, for example, based on a signal from a starter switch that represents the operating state of the starter motor.

(b) When the driver makes an engine stop request with the hood opened.

The condition (b) is set for the following reasons. That is, when the hood of the vehicle is open, a foreign object could become entangled with moving components in the engine compartment. Therefore, when an engine stop request is made with the vehicle hood opened, it is determined that the driver has made the request because a foreign object is entangled with moving components, and that the request is possibly an urgent engine stop request. Whether the hood is open is determined, for example, by a configuration in which a switch for detecting whether the hood is open is provided on the vehicle, and whether the switch is on or off is monitored by the electronic control unit 9.

(c) When the engine speed NE at the time when an engine stop request is made is higher than a predetermined determination value.

Whether an engine stop request is an urgent stop request is determined based on the engine speed NE at the time when the engine stop request is made for the following reasons. That is, during the normal engine operation, in other words, during the normal driving of the vehicle, it is unlikely that the driver requests an engine stop request when the engine speed is relatively high. Therefore, if a situation occurs in which an engine stop request is made by the driver when the engine speed is relatively high, it can be determined that the engine speed has excessively increased and the driver is attempting to stop the engine 1. In this case, the engine stop request can be determined to be an urgent stop request. The determination value is set to an engine speed at the time when an engine stop request is made during the normal engine operation. For example, the determination value is set to an idling speed or an engine speed during an idle-up operation for, for example, warming up the engine.

Using these conditions (a) to (c), it is reliably determined whether an engine stop request made by the driver at step S300 is an urgent stop request.

If it is determined that the urgent stop condition is not met at step S300 (NO at S300), the execution of the delay control is permitted (S310). That is, the execution of the delay process shown in FIG. 5 is permitted, and the main process is terminated.

If it is determined that the urgent stop condition is met at step S300 (YES at S300), the execution of the delay control is inhibited (S320). That is, the execution of the delay process shown in FIG. 5 is inhibited, and the engine 1 is stopped immediately. Then, the main process is terminated. Step S320 corresponds to the inhibiting means.

According to this embodiment, when the driver has made an urgent stop request, the engine operation is promptly stopped without executing the delay control. This improves the safety of the engine operation during the execution of the delay control.

Specifically, when an engine stop request is made during cranking, the engine 1 is promptly stopped based on the fact that the condition (a) is met. Therefore, the vehicle mounting the engine 1 that executes the delay control is prevented from starting moving due to the execution of the delay control during cranking.

When an engine stop request is made with the hood opened, the engine 1 is promptly stopped based on the fact that the condition (b) is met. Therefore, with the hood opened, when the driver discovers foreign entangled in the engine compartment, the engine 1 is promptly stopped based on an engine stop request made by the driver.

Since the condition (c) is set, whether an engine stop request is an urgent stop request is determined based on the engine speed at the time when the engine stop request is made. Therefore, if the driver makes an engine stop request when the engine speed is excessively high, the engine 1 is promptly stopped.

The second embodiment described above provides the following advantages.

(1) Whether an engine stop request made by the driver is an urgent stop request for promptly stopping the engine is determined. If the request is determined to be an urgent stop request, the execution of delay control is inhibited. Therefore, when the driver has made an urgent stop request, the engine operation is promptly stopped without executing the delay control, so that the safety of the engine operation during the execution of the delay control is increased.

(2) If the driver makes an engine stop request during cranking, whether the request is an urgent stop request is determined. Therefore, whether the engine stop request made by the driver is an urgent stop request is reliably determined.

(3) If the driver makes an engine stop request with the hood opened, whether the request is an urgent stop request is determined. Therefore, whether the engine stop request made by the driver is an urgent stop request is reliably determined.

(4) Whether an engine stop request made by the driver is an urgent stop request is determined based on the engine speed at the time when the engine stop request is made. Therefore, whether the engine stop request made by the driver is an urgent stop request is reliably determined.

Third Embodiment

A control apparatus for an internal injection engine according to a third embodiment of the present invention will now be described with reference to FIGS. 9 and 10.

In the first embodiment, the process for setting the throttle opening degree described above is executed to increase the safety of the engine operation during the execution of the delay control. In the second embodiment, the safety of the engine operation is increased in a different manner.

That is, if the delay control is executed when the engine power could rotate vehicle wheels, for example, when the driver is not applying the brakes, when the clutch of the transmission is engaged, or when the shift lever is not in the neutral position, the vehicle could start moving despite the fact that the engine stop request has been made.

In this embodiment, to prevent a contingency that the vehicle starts moving even if an engine stop request has been made, a stop mechanism for stopping the vehicle wheels of the vehicle mounting the engine 1 is actuated during the execution of the delay control, thereby increasing the safety of the engine operation during the execution of the delay control. Other than this process, the third embodiment is the same as the first embodiment. Therefore, hereinafter, the control apparatus for an internal combustion engine according to this embodiment will be described while mainly discussing the execution determination process.

Figure 9:
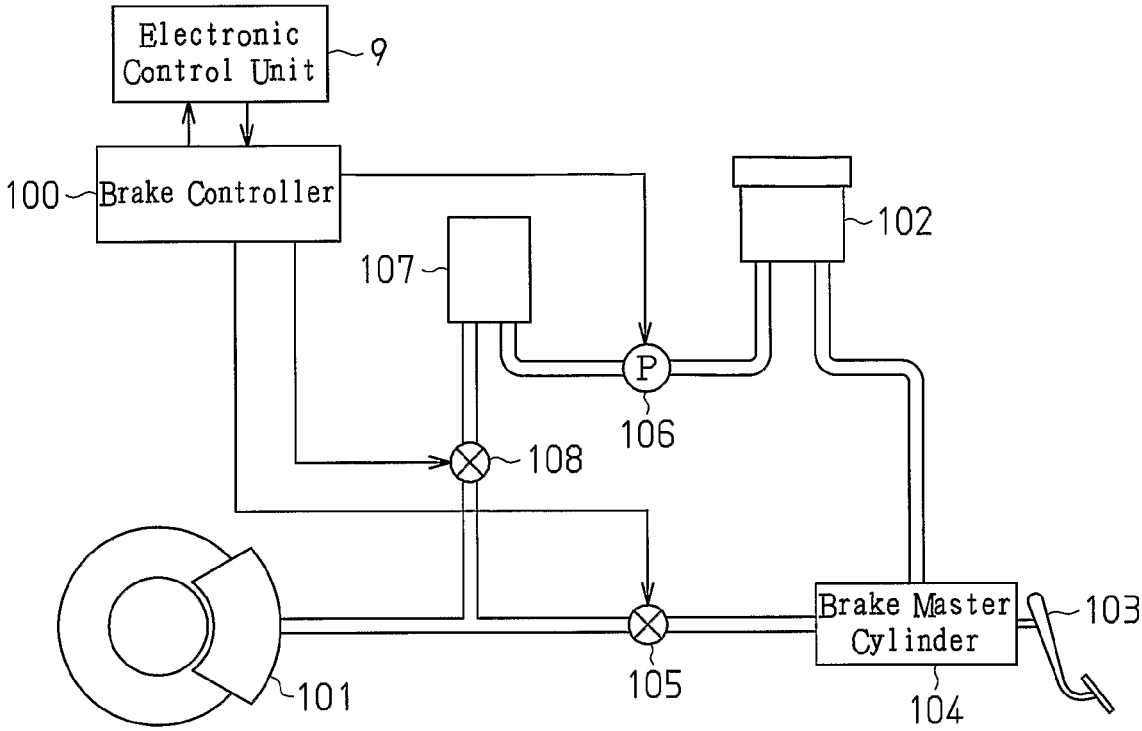
FIG. 9 is a diagrammatic view illustrating the basic structure of a stop mechanism according to a third embodiment.
Figure 10:
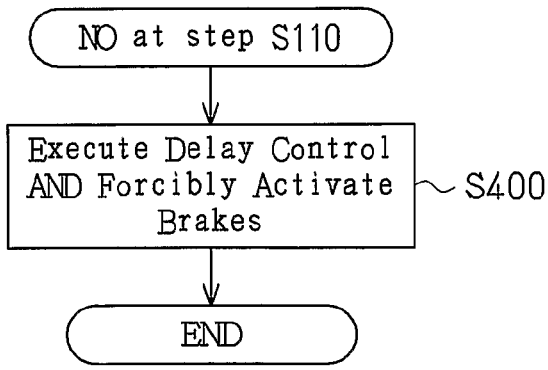
FIG. 10 is a flowchart showing a part of a procedure of a delay control according to the third embodiment.

FIG. 9 is a diagrammatic view illustrating the basic structure of the stop mechanism.

As shown in FIG. 9, the stop mechanism according to this embodiment includes a brake controller 100 controlled by the electronic control unit 9, hydraulic brakes 101 (only one is shown) each attached to one of the wheels of vehicle mounting the engine 1, two hydraulic system for supplying hydraulic pressure to the brakes 101, and a reserve tank 102 storing brake fluid of the two hydraulic systems.

The first hydraulic system is connected to a brake pedal 103 manipulated by the driver and to the reserve tank 102. The first hydraulic system includes a brake master cylinder 104 for generating hydraulic pressure, and a first valve 105 that is opened and closed by the brake controller 100. When the driver depresses the brake pedal 103, hydraulic pressure is generated in the brake master cylinder 104 of the first hydraulic system. When the first valve 105 is closed, hydraulic pressure generated by the brake master cylinder 104 is supplied to hydraulic cylinders of the brakes 101, which stops rotation of the wheels. That is, the first hydraulic system is configured as a hydraulic system for actuating the brakes 101 in response to manipulation by the driver.

The second hydraulic system is controlled by the brake controller 100, and includes a hydraulic pump 106 connected to the reserve tank 102, an accumulator 107 for preserving hydraulic pressure generated by the hydraulic pump, and a second valve 108 that is opened and closed by the brake controller 100. In the second hydraulic system, when the brake controller 100 actuates the hydraulic pump 106, hydraulic pressure generated by the hydraulic pump 106 is accumulated in the accumulator 107. When the second valve 108 is opened by the brake controller 100, the hydraulic pressure accumulated in the accumulator 107 is supplied to the hydraulic cylinders of the brakes 101, which stops rotation of the wheels. In this manner, the second hydraulic system is configured as a hydraulic system that is capable of actuating the brakes 101 even if the brake pedal 103 is not manipulated. In other words, the second hydraulic system is capable of actuating the brakes 101 without manipulation by the driver.

In the delay control according to the present embodiment, step S400 is executed instead of step S120 shown in FIG. 5. That is, if at step S110 of FIG. 5 it is determined that the predetermined period RT has not elapsed since the IG switch 60 was turned off (NO at S110), the second valve 108 is opened by the electronic control unit 9 when the delay control is executed, thereby forcibly actuating the brakes 101. By step S400, rotation of the wheels is forcibly stopped during the execution of the delay control. Accordingly, the problem that the execution of the delay control causes the vehicle to start moving is prevented. This increases the safety of the engine operation during the execution of the delay control.

Also, in the present embodiment, the wheels are stopped by the stop mechanism during the execution of the delay control. Therefore, a contingency that the vehicle starts moving even if an engine stop request has been made is prevented without executing the determination process, and inhibition process described in the second embodiment, that is, without the determination process shown in FIG. 8.

Since the vehicle wheels are stopped during the execution of the delay control in this embodiment, the problem that the execution of the delay control during cranking causes the vehicle to start moving is prevented.

The third embodiment described above provides the following advantages.

(1) The wheels are stopped by the stop mechanism during the execution of the delay control. Thus, the problem that the execution of the delay control causes the vehicle to start moving is prevented. This increases the safety of the engine operation during the execution of the delay control.

(2) The wheels are stopped by the stop mechanism during the execution of the delay control. Therefore, a contingency that the vehicle starts moving even if an engine stop request has been made is prevented without the determination process described in the second embodiment.

(3) The stop mechanism includes the brakes 101, which are actuated by the hydraulic pump 106, or an actuator. The vehicle wheels are therefore reliably stopped without relying on manipulation by the driver.

Fourth Embodiment

A control apparatus for an internal injection engine according to a fourth embodiment of the present invention will now be described with reference to FIGS. 11 and 12.

In this embodiment, a circuit for performing and stopping the supply of electricity to the fuel pump for supplying fuel to the injector 39 is added to the circuit shown in FIG. 4. At the time when the driver makes an engine stop request, the fuel pump is stopped.

Figure 11:
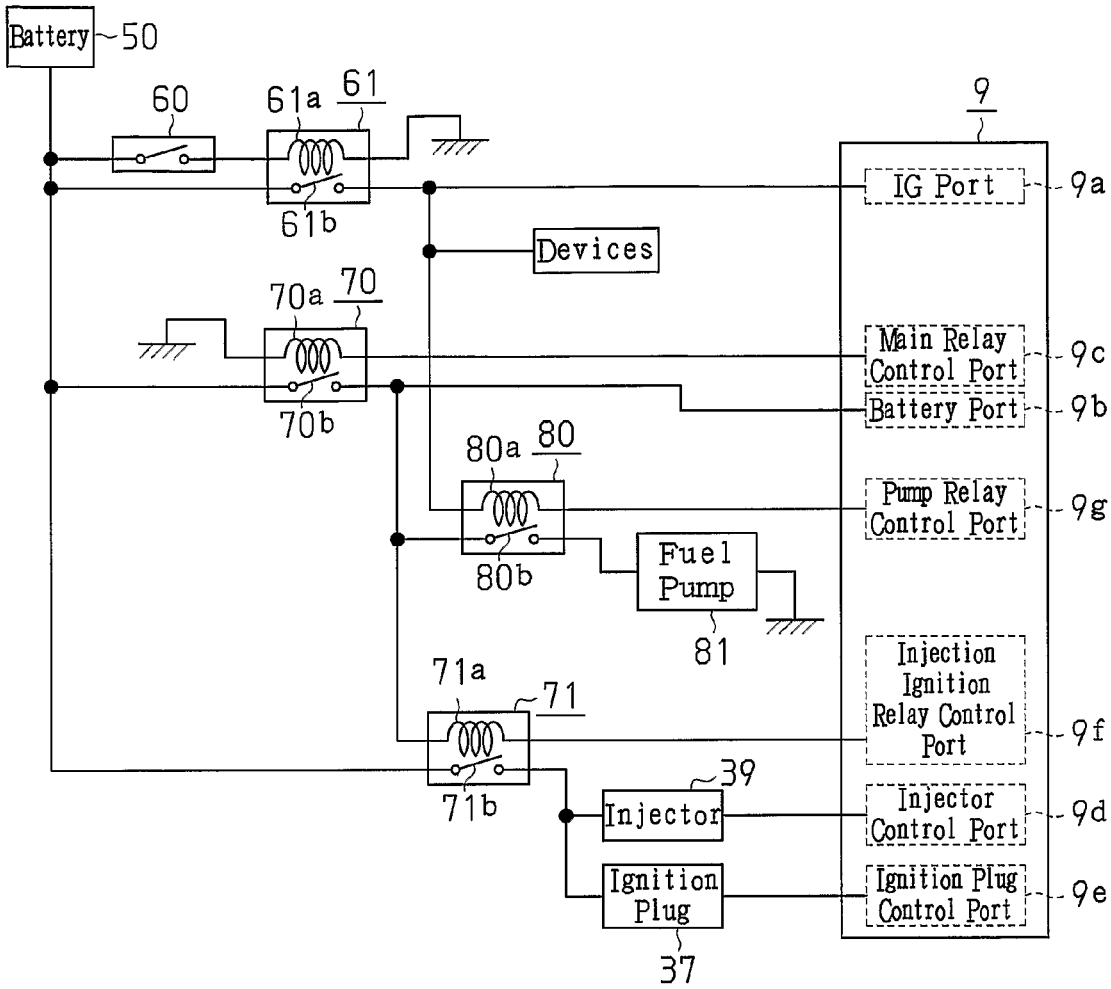
FIG. 11 is a schematic diagram showing a circuit for supplying electricity to a fuel pump according to a fourth embodiment.

FIG. 11 is a diagram showing a circuit for supplying electricity to the injector 39 and the ignition plug 37 in this embodiment. The circuit of FIG. 11 is different from the circuit shown in FIG. 4 in that a pump relay 80, a fuel pump 81, and a pump relay control port 9*g* are provided. Accordingly, the circuit according to this embodiment will be described while mainly discussing these differences.

As shown in FIG. 11, a first end of a coil 80*a* of the pump relay 80 that performs and shuts off the supply of electricity to the fuel pump 81 is connected to the downstream side of the contact 61*b* of the IG relay 61. A second end of the coil 80*a* is connected to the pump relay control port 9*g* of the electronic control unit 9. A first end of a contact 80*b* of the pump relay 80 is connected to the downstream side of the contact 70*b* of the main relay 70. The second end of the contact 80*b* is connected to the first terminal of the fuel pump 81. A second terminal of the fuel pump 81 is grounded.

In the relay circuit having the pump relay 80 as a main component, when the IG switch 60 is turned on, voltage is applied to the coil 80*a* via the contact 61*b* of the IG relay 61. When a Low level signal is outputted from the pump relay control port 9*g*, the coil 80*a* is excited and the contact 80*b* is closed. When the electronic control unit 9 recognizes an engine start request, the contact 70*b* of the main relay 70 is closed. Thus, the engine start request is recognized. When a Low level signal is outputted from the pump relay control port 9*g*, electricity is supplied to the fuel pump 81 through the contact 70*b* and the contact 80*b*, so that the fuel pump 81 is actuated. When a High level signal is outputted from the pump relay control port 9*g*, the coil 80*a* is de-excited and the contact 80*b* is opened. This stops the supply of electricity to the fuel pump 81, so that the operation of the fuel pump 81 is stopped.

Figure 12:
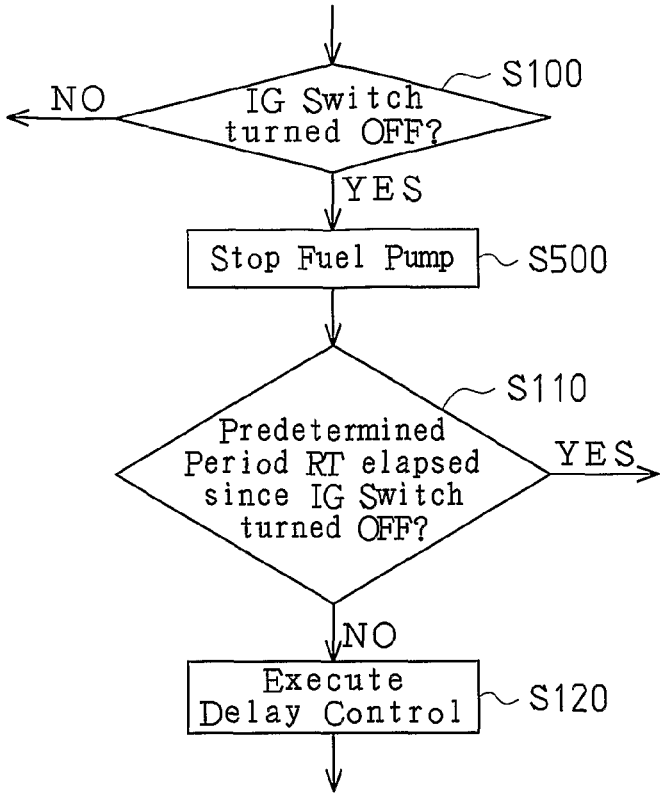
FIG. 12 is a flowchart showing a part of a procedure of a delay control according to the fourth embodiment.

In the delay control of this embodiment, when the decision outcome at step S100 of FIG. 5 is positive, step S500 of FIG. 12 is executed. After step S500 is executed, step S110 of FIG. 5 is executed. That is, if the IG switch 60 is determined to be off at step 100 of FIG. 5 (YES at S100), a High level signal is outputted from the pump relay control port 9*g*, and the fuel pump 81 is stopped (S500). Thereafter, whether the predetermined period RT has elapsed since the IG switch 60 was turned off is determined (S110). If the predetermined period RT has not elapsed (NO at S110), the delay control is executed (S120).

In this manner, the fuel pump 81 is stopped at the time when an engine stop request is made in this embodiment. That is, when an engine stop request is made, the supply of fuel to the injector 39 is immediately stopped. Specifically, the fuel pump 81 is stopped prior to the execution of the delay control, so that the supply of fuel to the injector 39 is stopped. Therefore, even in the case where continuation of the engine operation by the delay control is not ended, that is, even in the case where there is an abnormality in the delay control, the engine operation is reliably stopped. This increases the safety of the engine operation during the execution of the delay control.

The fourth embodiment described above provides the following advantages.

(1) The fuel pump 81 is stopped at the time when the driver makes an engine stop request. Therefore, even if the continuation of the engine operation according to the delay control is ended, that is, even if there is an abnormality in the delay control, the engine operation is reliably stopped. This increases the safety of the engine operation.

The above embodiments may be modified as follows.

Figure 13:
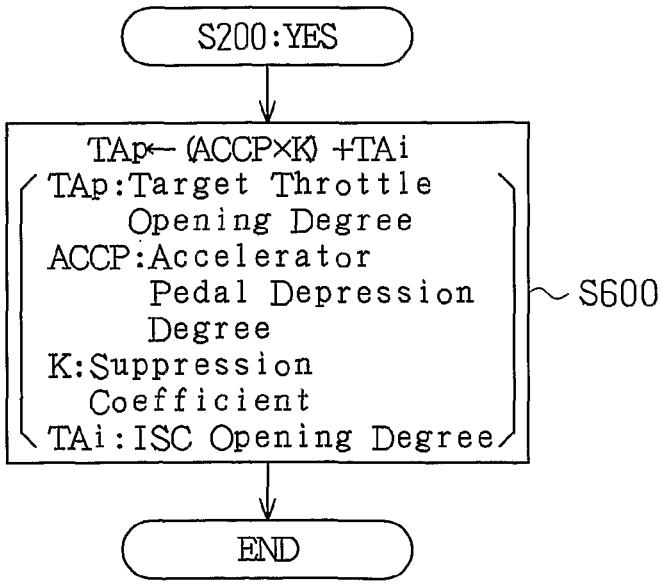
FIG. 13 is a flowchart showing a procedure for setting a throttle opening degree according to a modification of the first embodiment.

In the first embodiment, setting of the opening degree of the throttle valve 38 in accordance with the accelerator pedal depression degree ACCP is inhibited during the execution of the delay control, so that the throttle opening degree set during the execution of the delay control is less than the throttle opening degree during the non-execution of the delay control. Alternatively, step S220 of FIG. 6 may be replaced by step S600 of FIG. 13, so that the throttle opening degree setting process is executed. That is, if it is determined that the delay control is being executed (YES at S200), the target throttle opening degree TAp may be set according to the following expression (3).

$$TAp \leftarrow (\text{Accelerator pedal depression degree } ACCP \times \text{Suppression coefficient}) + ISC \text{ opening degree } TAi \quad (3)$$

The suppression coefficient is determined in advance to be a value equal to or greater than zero and less than one. Therefore, the target throttle opening degree TAp, which is set according to the expression (3), that is, the target throttle opening degree TAp set during the execution of the delay control, is less than the target throttle opening degree TAp that is set during the non-execution of the delay control.

According to this modification, during the execution of the delay control, the throttle valve opening degree set according to the accelerator pedal depression degree ACCP is less than that during the non-execution of the delay control, that is, that during the normal operating state. Therefore, during the execution of the delay control, accidental depression of the accelerator pedal by the driver increases the throttle valve opening degree by an amount less than that in the normal operating state. In this case, during the execution of the delay control, if the engine power and the engine speed are not increased by accidental depression of the accelerator pedal by the driver. This increases the safety of the engine operation during the execution of the delay control.

In the first embodiment, the throttle opening degree set according to the accelerator pedal depression degree ACCP is set relatively small during the execution of the delay control. This configuration may be changed as long as an engine control amount that is set according to the manipulation of the engine 1 performed by the driver is set less during the execution of the delay control than during the non-execution of the delay control. In this case, the engine control amount set according to engine manipulation performed by the driver is set less during the execution of the delay control compared to the period of non-execution of the delay control. In other words, the engine control amount is less during the execution of the delay control than during the normal engine operation. Therefore, during the execution of the delay control, the problem that the engine operating state is significantly changed by an accidental manipulation of the driver even if the driver has made an engine stop request is prevented. This increases the safety of the engine operation during the execution of the delay control. When the throttle opening degree is adjusted according to the accelerator pedal depression degree, the intake air amount is also changed. Accordingly, the fuel injection amount is changed. That is, the fuel injection amount is set indirectly according to the accelerator pedal depression degree. In the case of a direct injection engine, the fuel injection amount is set directly based on the accelerator pedal depression degree in some cases. Therefore, engine operation amounts set according to manipulation of the engine 1 include the fuel injection amount.

In the first embodiment, the circuit shown in FIG. 4 represents only one example. If other circuits are used for supplying electricity to the injector 39 and the ignition plug 37, the same advantage as item (1) of the first embodiment is obtained.

In the second embodiment, the conditions (a) to (c) are used for determining whether a stop request is an urgent stop request. However, only one of the conditions (a) to (c) may be used. Further, any conditions other than the conditions (a) to (c) may be used on a timely basis as long as additional conditions can be used for determining an urgent stop request.

The hydraulic system in the third embodiment is only one example, and may be changed as long as the system is capable of stopping the vehicle wheels without depending on manipulation by the driver.

In the third embodiment, the brakes 101 may be replaced by brakes actuated by electric motors. In this case also, during the execution of the delay control, the brakes function in the same manner as the brakes 101 through actuation of the electric motors, and have the same advantages as the brakes 101.

In the third embodiment, the mechanism for stopping the wheels is the brakes 101. However, in the case of a vehicle having an automatic transmission, the parking brake mechanism provided in the automatic transmission may be actuated to stop rotation of the wheels during the execution of the delay control. This configuration also provides the same advantages as the third embodiment.

In the fourth embodiment, the fuel pump 81 is stopped at the time when the engine stop request is made. This configuration may be changed. For example, during the execution of the delay control, the fuel pump 81 may be stopped when a predetermined period has elapsed since the engine stop request is made.

Figure 14:
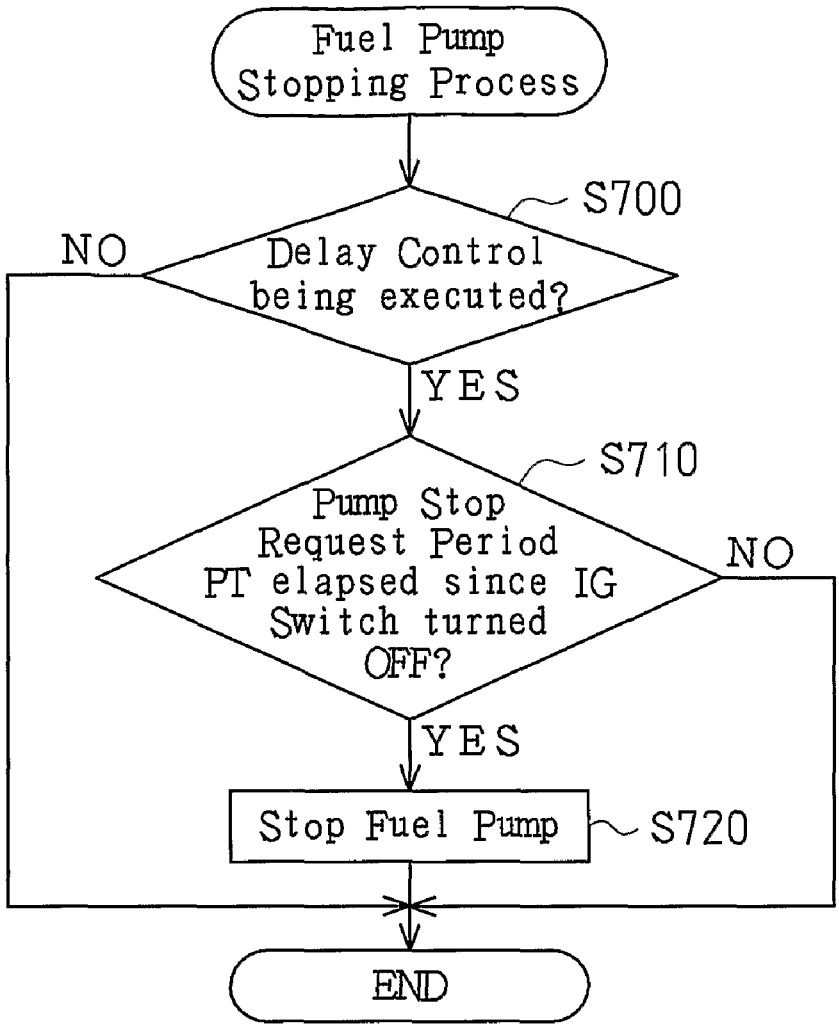
FIG. 14 is a flowchart showing a fuel pump stopping process according to a modification of the fourth embodiment.

This modification is realized by executing a fuel pump stopping process shown in FIG. 14.

The fuel pump stopping procedure shown in FIG. 14 is executed by the electronic control unit 9 when the IG switch 60 is turned off, that is, when the driver makes an engine stop request.

When the procedure is started, whether the delay control is being executed is determined (S700). If it is determined that the delay control is not being executed (NO at S700), this process is temporarily suspended.

on the other hand, when the delay control is being executed (YES at S700), whether a predetermined period PT has elapsed since the IG switch 60 was turned off is determined (S710). The pump stop request period PT is preferably set to be the same as the predetermined period RT, that is, the period required for changing the valve characteristics of the intake valve 35 to the valve characteristics for starting the engine 1 during the execution of the delay control. However, the pump stop request period PT may be changed as necessary.

If it is determined that the pump stop request period has not elapsed (NO at S710), this process is temporarily suspended. If it is determined that the pump stop request period has elapsed (YES at S710), the fuel pump 81 is stopped and this process is terminated.

During the execution of the delay control, if the fuel pump 81 is stopped when a predetermined period has elapsed since an engine stop request is made, the supply of fuel to the injector 39 is stopped when the predetermined period has elapsed since the engine stop request is made even during the execution of the delay control. Therefore, in this modification, if the continuation of the engine operation according to the delay control is ended, that is, if there is an abnormality in the delay control, the engine operation is reliably stopped. This increases the safety of the engine operation.

In the illustrated embodiments, the delay control is ended when the predetermined period RT has elapsed. Instead, a configuration may be applied in which the delay control is ended when the valve characteristics of the intake valve 35 become valve characteristics for starting the engine 1.

Figure 15:
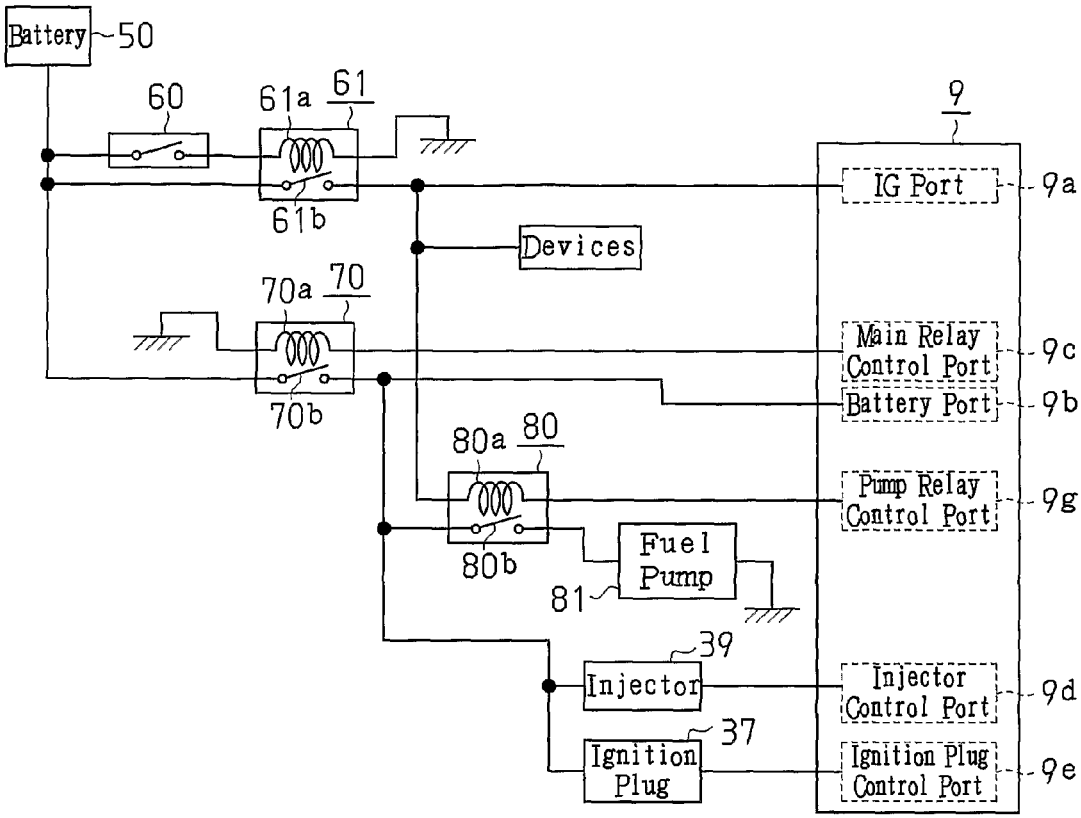
FIG. 15 is a schematic diagram showing a modification of a circuit for supplying electricity to the injector and the ignition plug according to a modified embodiment.

In the illustrated embodiments, the supply of electricity to the injector 39 and the ignition plug 37 is performed and shut off by the injection ignition relay 71. However, as shown in FIG. 15, the injection ignition relay 71 may be omitted. In this case, first ends of the injector 39 and the ignition plug 37 (igniter) are connected to the downstream side of the contact 70*b* of the main relay 70, so that electricity is directly supplied to the injector 39 and the ignition plug 37 when the contact 70*b* is closed. The second end of the injector 39 is connected to the injector control port 9*d*, and the second end of the ignition plug 37 (igniter) is connected to the ignition plug control port 9*e*, so that fuel injection and fuel ignition are control based on signals from the injector control port 9*d* and the ignition plug control port 9*e*. In this manner, the injection ignition relay 71 may be omitted, and the supply of electricity to the injector 39 and the ignition plug 37 may be performed and shut off directly in response to control signals from the electronic control unit 9. In this case, if the supply of current to the injector 39 and the ignition plug 37 is performed and shut off by the circuit independent from the IG switch 60, the circuit configuration is simplified. Accordingly, the costs and failure rates are reduced.

It may be configured that the supply of electricity to one of the injector 39 and the ignition plug 37 is performed and shut off by the injection ignition relay 71, and the supply of electricity to the other is performed and shut off directly in response to signals from the electronic control unit 9 as described above.

In the illustrated embodiments, when stopping the engine 1 by terminating the delay control, fuel injection and fuel ignition are simultaneously stopped. This configuration could have the following drawbacks. Such drawbacks in a four cylinder engine will be described as an example with reference to FIG. 16. In this engine, fuel injection and fuel ignition are executed in the order of a first cylinder #1, a third cylinder #3, a fourth cylinder #4, and a second cylinder #2.

Figure 16:
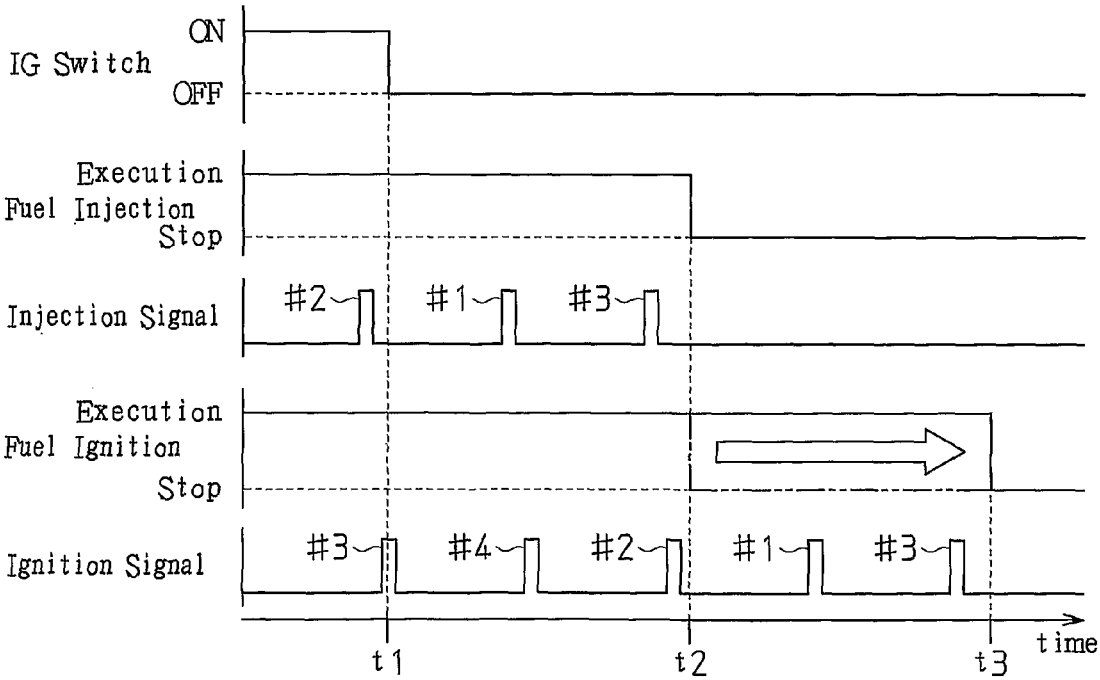
FIG. 16 is a time chart showing points at which fuel injection and fuel ignition are stopped for terminating the delay control.

As shown in FIG. 16, when the IG switch 60 is turned off at time t1, fuel injection and fuel ignition are continued for executing the delay control. At time t2 when a certain period has elapsed since time t1, if fuel injection and fuel ignition are simultaneously executed, fuel that has been injection in a period from time t1 to time t2 (fuel injected into the first cylinder #1 and the third cylinder #3 in the example of FIG. 16) will not be ignited and remain in the cylinders. Such residual fuel in the cylinders results in unburned fuel being discharged of the engine 1 when the engine 1 is started next time. Further, deposit resulting from the residual fuel will collect on the surface of each combustion chamber.

On the other hand, if it is configured that fuel injection is stopped at time t2, and fuel ignition is stopped at time t3, or when a certain period has elapsed since time t2 (for example, a period required for fuel injected into the third cylinder #3 to be ignited), fuel that has been injected into the first cylinder #1 and the third cylinder #3 is ignited in a period from time t2 to time t3. Therefore, fuel injected during the execution of the delay control does not remain in the cylinders.

Thus, the illustrated embodiments may be modified such that, when terminating the delay control, fuel injection is first stopped, and fuel ignition is stopped thereafter. In this case, residual fuel in the cylinders is reliably suppressed.

In the illustrated embodiments, the variable valve timing mechanism 51 is a hydraulic mechanism. However, the present invention may be applied to an electric variable valve timing mechanism. In the illustrated embodiments, the variable valve lift mechanism 53 is an electric mechanism. However, the present invention may be applied to a hydraulic variable valve lift mechanism.

In the illustrated embodiments, the variable valve actuation mechanism 5 is provided for varying the valve characteristics of the intake valve 35. However, the present invention may be applied to a case where the variable valve actuation mechanism 5 is provided for changing the valve characteristics of the exhaust valve 36. In the illustrated embodiments, the variable valve actuation mechanism 5 includes the variable valve timing mechanism 51 and the variable valve lift mechanism 53. However, the present invention may be applied to a case where the variable valve actuation mechanism 5 includes only the variable valve timing mechanism 51 or only the variable valve lift mechanism 53. The present invention may be applied to any type of variable valve actuation mechanism other than the variable valve, actuation mechanism 5 as long as the mechanism the valve characteristics of engine valves, such as intake valves and exhaust valves according to the engine operating state.

The present invention may be embodied by combining the first embodiment and the third embodiment, combining the first embodiment and the fourth embodiment, combining the second embodiment and the third embodiment, combining the second embodiment and the fourth embodiment, or combining the third embodiment and the fourth embodiment. Further, the present invention may be embodied by combining the first embodiment, the third embodiment, and the fourth embodiment, or combining the second embodiment, the third embodiment, and the fourth embodiment.

In the illustrated embodiments, the present invention is applied to the gasoline engine 1 having the ignition plugs. However, the present invention may be applied to other types of engines, such as a diesel engine.

The invention claimed is:

1. A control apparatus for an internal combustion engine, comprising:

delay means for performing a delay control for extending the period from when an engine stop request is made to when the engine is actually stopped;

changing means for actuating a variable valve actuation mechanism during the execution of the delay control, thereby changing the valve characteristics of an engine valve to valve characteristics for starting the engine;

setting means for setting an engine control amount that corresponds to engine manipulation performed by a driver; and limiting means for causing the engine control amount set during the execution of the delay control to be less than the engine control amount during non-execution of the delay control, wherein the setting means sets an opening degree of a throttle valve according to a depression degree of an accelerator pedal, wherein the limiting means causes the throttle valve opening degree set during the execution of the delay control to be less than the throttle valve opening degree during non-execution of the delay control.

2. The control apparatus according to claim 1, wherein the limiting means, during the execution of the delay control, inhibits setting of the throttle valve opening degree that corresponds to the accelerator pedal depression degree.

3. The control apparatus according to claim 1, further comprising:

determination means for determining whether the engine stop request is an urgent stop request; and inhibiting means, wherein, when the determination means determines that the stop request is an urgent stop request, the inhibiting means inhibits the execution of the delay control.

4. The control apparatus according to claim 3, wherein when the engine stop request is made during cranking of the engine, the determination means determines that the engine stop request is the urgent stop request.

5. The control apparatus according to claim 3, wherein when the engine stop request is made with the hood of the vehicle mounting the engine opened, the determination means determines that the engine stop request is the urgent stop request.

6. The control apparatus according to claim 3, wherein the determination means determines whether the engine stop request is the urgent stop request based on an engine speed at the time when the engine stop request is made.

7. The control apparatus according to claim 1, further comprising:

a stop mechanism that stops wheels of a vehicle mounting the engine, wherein the stop mechanism is actuated during the execution of the delay control.

8. The control apparatus according to claim 7, wherein the stop mechanism comprises brakes actuated by an actuator.

9. The control apparatus according to claim 1, further comprising:

a main relay formed in a circuit independent from an engine stopping switch, the main relay performing and shutting off supply of electricity used for controlling the engine;

a separate relay formed in a circuit independent from the engine stopping switch, the separate relay performing and shutting off the supply of electricity to at least one of a fuel injection valve and an ignition plug;

wherein the delay means performs a delay control for extending the period from when an engine stop request is made by the driver to when the separate relay shuts off the supply of electricity, and wherein the main relay performs and shuts off the supply of electricity to the separate relay.

10. The control apparatus according to claim 9, wherein a coil of the separate relay is connected to a downstream side of a contact of the main relay.

11. A control apparatus for an internal combustion engine, comprising:

a delay section that performs a delay control for extending the period from when an engine stop request is made to when the engine is actually stopped;

a changing section that actuates a variable valve actuation mechanism during execution of the delay control, thereby changing valve characteristics of an engine valve to valve characteristics for starting the engine;

a setting section that sets an engine control amount that corresponds to engine manipulation performed by a driver; and a limiting section that causes the engine control amount set during the execution of the delay control to be less than the engine control amount during non-execution of the delay control, wherein the setting section sets an opening degree of a throttle valve according to a depression degree of an accelerator pedal, and wherein the limiting section causes the throttle valve opening degree set during the execution of the delay control to be less than the throttle valve opening degree during non-execution of the delay control.

12. The control apparatus according to claim 11, wherein the limiting section, during the execution of the delay control, inhibits setting of the throttle valve opening degree that corresponds to the accelerator pedal depression degree.

13. The control apparatus according to claim 11, further comprising:

a determination section that determines whether the engine stop request is an urgent stop request; and an inhibiting section, wherein, when the determination section determines that the stop request is an urgent stop request, the inhibiting section inhibits the execution of the delay control.

14. The control apparatus according to claim 13, wherein, when the engine stop request is made during cranking of the engine, the determination section determines that the engine stop request is the urgent stop request.

15. The control apparatus according to claim 13, wherein, when the engine stop request is made with the hood of the vehicle mounting the engine opened, the determination section determines that the engine stop request is the urgent stop request.

16. The control apparatus according to claim 13, wherein the determination section determines whether the engine stop request is the urgent stop request based on an engine speed at the time when the engine stop request is made.

17. The control apparatus according to claim 11, further comprising:

a stop mechanism that stops wheels of a vehicle mounting the engine, wherein the stop mechanism is actuated during the execution of the delay control.

18. The control apparatus according to claim 17, wherein the stop mechanism comprises brakes actuated by an actuator.

19. The control apparatus accordingly to claim 11, further comprising:

a main relay formed in a circuit independent from an engine stopping switch, the main relay performing and shutting off supply of electricity used for controlling the engine;

a separate relay formed in a circuit independent from the engine stopping switch, the separate relay performing and shutting off the supply of electricity to at least one of a fuel injection valve and an ignition plug;

wherein the delay section performs a delay control for extending the period from when an engine stop request is made by the driver to when the separate relay shuts off the supply of electricity, and wherein the main relay performs and shuts off the supply of electricity to the separate relay.

20. The control apparatus according to claim 19, wherein a coil of the separate relay is connected to a downstream side of a contact of the main relay.

* * * * *